United States Patent [19]

Costello

[11] Patent Number: 4,657,113

[45] Date of Patent: Apr. 14, 1987

[54] APPARATUS FOR ELEVATING AND LOWERING SCAFFOLDING

[76] Inventor: Colm J. Costello, 4 Seamount Road, Malahide, County Dublin, Ireland

[21] Appl. No.: 820,403

[22] Filed: Jan. 17, 1986

[30] Foreign Application Priority Data

Jan. 24, 1985 [IE] Ireland ..... 158/85
Oct. 4, 1985 [IE] Ireland ..... 2432/85

[51] Int. Cl.[4] ..... E04G 1/34

[52] U.S. Cl. ..... 182/63; 182/41; 182/152; 52/632

[58] Field of Search ..... 182/63, 152, 178, 40, 182/41; 52/632, 117

[56] References Cited

U.S. PATENT DOCUMENTS 2,794,558 6/1957 Miles ..... 182/63
2,982,379 5/1961 Fisher ..... 182/178
3,221,838 12/1965 Brayton ..... 182/178
3,504,461 4/1970 Copeland ..... 182/178
3,593,481 7/1971 Mikulin ..... 52/632
3,684,056 8/1972 Penso ..... 182/178
3,751,863 8/1973 Lyons ..... 52/632
4,027,440 6/1977 Hamblin ..... 182/41
4,578,919 4/1986 Amadon ..... 52/632

*Primary Examiner*—Reinaldo P. Machado
*Attorney, Agent, or Firm*—Phillips, Moore, Lempio & Finley

[57] ABSTRACT

The invention provides apparatus for elevating and lowering scaffolding. A scaffold tower is moved horizontally so as to be supported on movable guides which are in a lowered position. The movable guides are then moved upwards. When the movable guides have reached an upper position, the scaffolding is then moved horizontally in the opposite direction so as to be supported on fixed guides. The operation is repeated as often as necessary. As stages are elevated, further stages are erected one by one below the stages being erected. The apparatus may also be operated to lower a scaffold tower, while collapsing stages one by one.

9 Claims, 24 Drawing Figures

APPARATUS FOR ELEVATING AND LOWERING SCAFFOLDING

FIELD OF THE INVENTION

The present invention relates to apparatus for elevating and lowering a scaffold tower, such that the tower may be elevated and further scaffolding erected beneath the tower to increase the height of the tower, and such that scaffolding may be collapsed at the bottom of the tower and the tower lowered to reduce the height of the tower.

PRIOR ART

Apparatus as described above is disclosed in U.S. Pat. No. 3,593,481 to Mikulin and in U.S. Pat. No. 3,751,863 to Lyons. The two specifications each disclose a variable height scaffold unit comprising a base and, mounted on the base, a plurality of scaffold stages each of which stages may be moved between a collapsed state and an erect state, the stages being connected one above the other in a vertically extending series. The stages may be erected one by one working downwards along the series, while simultaneously elevating all the stages above the stage which is being erected. Similarly, the stages may be collapsed one by one working upwards along the series, while simultaneously lowering all the stages above the stage which is being collapsed.

Mikulin discloses apparaatus for elevating and lowering a scaffold tower, comprising pairs of vertically extending endless chains provided at each side of the scaffolding, and having extending between them pairs of horizontal transverse connecting cross bars. The cross bars of a pair are disposed one above the other with a small gap between them. When erecting scaffolding, the endless chains are driven so that the transverse connecting cross bars engage between them toothed blocks on the topmost collapsed stage of the open frame scaffold, and then move upwardly causing the topmost collapsed stage to erect while simultaneously elevating all the stages above the stage being erected.

Lyons discloses similar apparatus for elevating and lowering a scaffold tower, comprising endless chains provided with pin and roller arrangements for engaging brackets on the topmost collapsed stage.

Lyons also discloses similar apparatus for elevating and lowering a scaffold tower, comprising a central vertical worm shaft mounted on the base. Rotation of the worm shaft causes the topmost collapsed stage to rise up along the worm while simultaneously elevating all the stages above the stage being erected. The stage becomes fully erect just as it reaches the end of the worm. Each stage is provided with a central internally screw threaded ring for engaging the external thread of the worm shaft, the ring being supported by four support bars extending diagonally from the four corners of the stage.

The use of chains is undesirable because the chains may flex in use, allowing scaffolding which they support to fall. Furthermore, chains wear.

SUMMARY OF THE INVENTION

One object of the present invention is to provide apparatus for elevating and lowering scaffolding which is simpler and therefore less expensive than the prior art apparatus and which is more reliable.

Another object of the invention is to provide apparatus which enables scaffolding to be raised by a height of less than the height of a full scaffold stage.

A further object of the invention is to provide apparatus which enables scaffolding to be raised up from ground level by a single operative and not limited to employing only collapsed stages already provided mounted on the base and connected one above the other in series.

The invention provides apparatus for elevating and lowering scaffolding comprising: (a) a base; (b) associated with the base, a plurality of movable scaffold guides, such that repeating elements of an erect scaffold stage disposed above the base may be moved horizontally in one direction so as to be supported by the movable guides; (c) vertical movement means for causing simultaneous movement, between a lower and upper position, of the movable guides and scaffold elements supported thereby; (d) associated with the base, a plurality of fixed guides, such that elements of an erect scaffold stage above the base may be moved horizontally in the opposite direction so as to be supported by the fixed guides; and (e) means for preventing horizontal movement of erect scaffold stages in either direction when the movable guides are between the lower and upper positions; whereby scaffolding may be elevated or lowered by operating the vertical movement means to move the movable guides to their lower or upper positions respectively, moving the scaffolding horizontally so that elements of an erect stage of the scaffolding are supported by the movable guides, then operating the vertical movement means to move the movable guides to their opposite position respectively, and finally moving the scaffolding horizontally so that repeating elements of an erect stage of the scaffolding are supported by the fixed guides.

Advantageously, the fixed guides can support scaffold elements at different levels so that the scaffold tower may be elevated by less than the vertical separation of repeting elements of the scaffolding.

Advantageously, the vertical movement means comprises a lever pivotally mounted to the base which serves as a fulcrum, and connected to the movable guides which constitute the load.

BRIEF DESCRIPTION OF THE DRAWINGS

The invention will now be described more particularly with reference to the accompanying drawings which illustrate, by way of example, a scaffold unit provided with apparatus according to the invention for elevating and lowering a scaffold tower, and a modification of the unit.

In the drawings.

DESCRIPTION OF THE INVENTION

Figure 1:
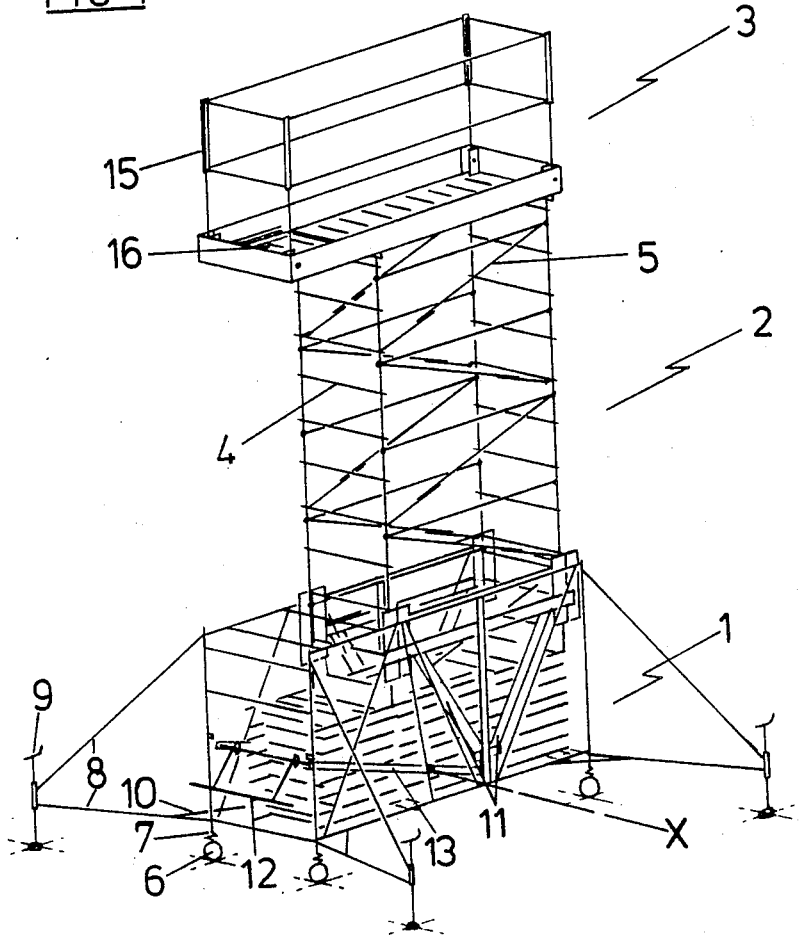
FIG. 1 is a perspective view of the scaffold unit.

Referring now to the drawings, and initially to FIG. 1, the scaffold unit comprises a base or chassis 1, a plurality of scaffold stages 2 connected to one another in a vertical series, a number of which are shown erected to form a scaffold tower and a number of which are shown collapsed into the chassis 1, and a platform 3 above the stages 2. The scaffold stages 2 include rungs 4 which combine to define a ladder. It will be noted that there are two rungs 4 at each end of each stage 2. Each stage is about a half meter in height. The scaffold stages 2 also include jointed diagnonal braces 5. The chassis 1 is supported on four castors 6 mounted on legs 7. The length of each leg 7 is adjustable to ensure that the chassis 1 is horizontal when in use. In use, the chassis 1 is braced at each corner by means of a stabiliser 8 provided with an adjustable screw jack 9 and further provided with an auxiliary brace 10. The scaffold tower may be raised or lowered by means of an elevation mechanism 11 mounted on and within the chassis 1. A selector lever 43, at the far side of the chassis as seen in FIG. 1, allows selection of the raising or lowering mode. The elevation mechanism 11 is operated in a particular mode by means of a foot pedal 12 at the end of a pedal lever 13, which is pivoted at axis X. The pedal lever 13 is thus a type 1 lever having its fulcrum on the chassis 1.

The operation of the scaffold unit will now be outlined before proceeding to a more detailed description of the apparatus. The unit may be operated by a single operative. The unit is pushed or pulled to the desired location. The legs 7 are adjusted, if necessary, to ensure tht the chassis 1 is horizontal. The stabilisers 8, which were folded against the chassis 1 during movement, are swung outwards to the operational position shown in FIG. 1. The auxiliary braces 10, which were folded against the stabilisers 8 during movement, are swung outwards and secured to the chassis 1. The screw jacks 9 are tightened to secure the chassis 1 against movement. Guard rails 15 on the platform 3, which were in the collapsed state during movement, are erected. The selector lever 43 is moved to the appropriate position for the elevation mode. The stages 2, all of which were in the collapsed state during movement except the topmost one, are erected and raised one by one until the platform 3 reaches the desired height.

To raise the topmost stage 2, the operative pushes the foot pedal 12 upwards to ensure that the elevation mechanism 11 is at its lowest position. The elevation mechanism 11 engages the upper ladder rungs 4 of the topmost stage, which is erect. The foot pedal 12 is then depressed, causing the elevation mechanism 11 to rise, bringing the topmost stage 2 with it. When the topmost stage 2 has been raised by quarter the height of a stage, the elevation mechanism 11 automatically releases the upper rungs 4 which are held at this new height. Foot pedal 12 is then raised to lower the elevation mechanism 11. The mechanism 11 now engages the lower rungs 4 of the topmost stage 2. The foot pedal 12 is now depressed to raise the elevation mechanism 11 so that the topmost stage 2 again rises quarter the height of a stage bringing the lower rungs of the stage to the position originally occupied by the upper rungs 4 and bringing the upper rungs up another quarter stage in height. Thus the topmost stage 2, which was already in the erect state, is raised by a distance equal to half the height of a stage. The procedure is repeated twice more to raise the topmost stage through a cumulative distance equal to the height of a stage. As the topmost stage is raised, the second stage, which is connected below it, automatically unfolds to the erect configuration. When the elevation mechanism 11 is subsequently lowered, associated brace straightening means push against the jointed diagonal brace 5 of the second stage, causing the brace 5 to straighten out, thereby locking the second stage rigidly in the erect state.

The process of raising an already erect stage, and simultaneously erecting the next following stage, is repeated as often as required, working downwards along the series, until the platform 3 reaches the desired height. The pedal lever 13 is then locked to prevent the tower collapsing accidentally. The lowermost erect stage is then secured against any movement or play, which would of course be magnified further up the tower. The operative mounts the platform 3 via the foot pedal 12, the chassis 1, the ladder rungs 4 and trapdoor 16. A safety feature of the unit is that the guard rails 15, when folded, lie on the floor of the platform 3 on top of the trapdoor 16, and thus the trapdoor cannot be opened unless the guard rails have been erected.

To collapse the stages 2, the selector lever 43 is moved to the appropriate position for collapse, the pedal lever 13 and lowermost erect stage are released, and the foot pedal 12 is repeatedly depressed and raised, bringing the stages down by a distance equal to quarter the height of a stage each time the pedal is depressed and raised.

It is not necessary to collapse all the stages 2 between use or when varying the height. Additional stages 2 may be erected or collapsed from time to time as required. Furthermore, the height of the tower may be varied by only one rung, that is half the height of a stage. The apparatus will now be described in more detail.

Figure 2:
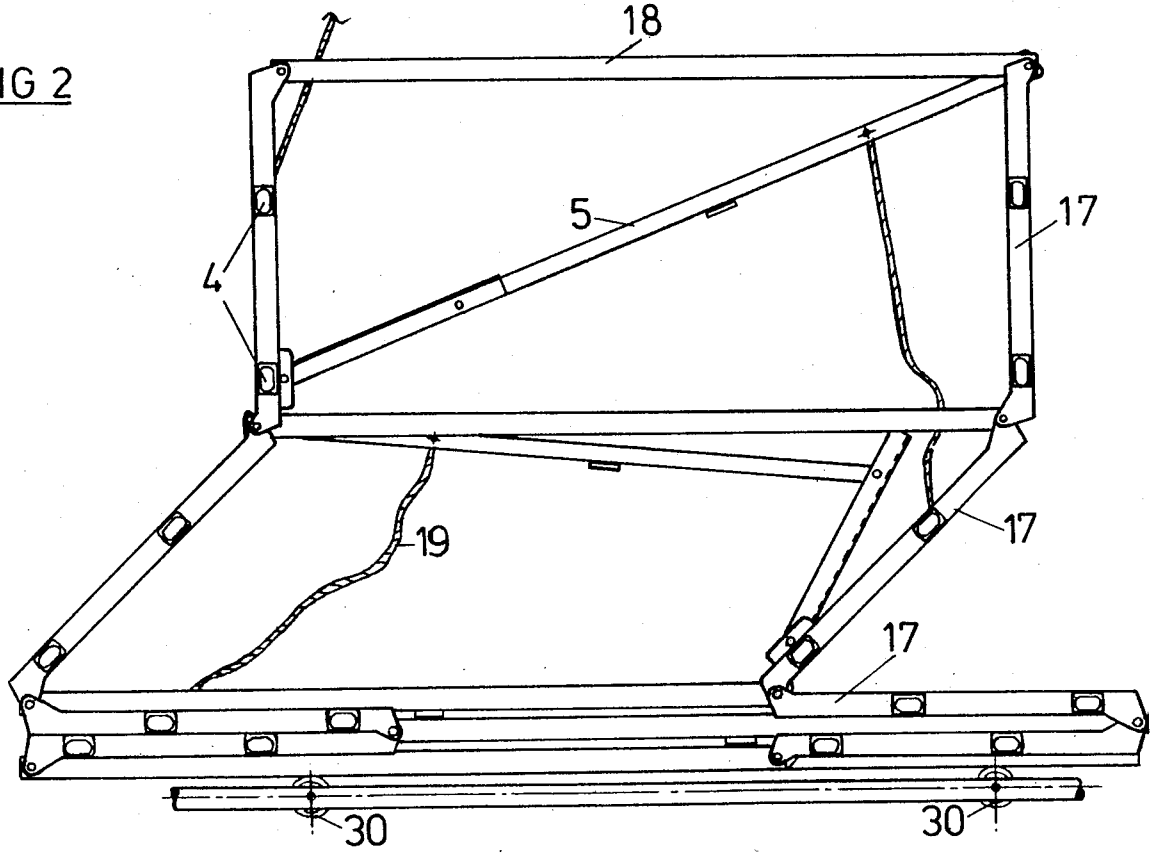
FIG. 2 is a side elevation of four stages, one erect, one partially erect, and two collapsed.

Referring to FIG. 2, each stage comprises vertical stiles 17, horizontal lengthwise braces 18, and transverse rungs 4 at each end, which together form a readily erectable and collapsible parallelepiped open frame structure. Jointed diagonal braces 5 hold the parallelepiped structure rigid in the erect state. The stage 2 is collapsed by knuckling open the jointed diagonal braces 5 to the position which may be seen in the partially erect stage. Flexible straps 19 join each stage 2 to the stage beneath so that each stage can be collapsed only when the stage immediately beneath it is in the collapsed state.

Figure 3:
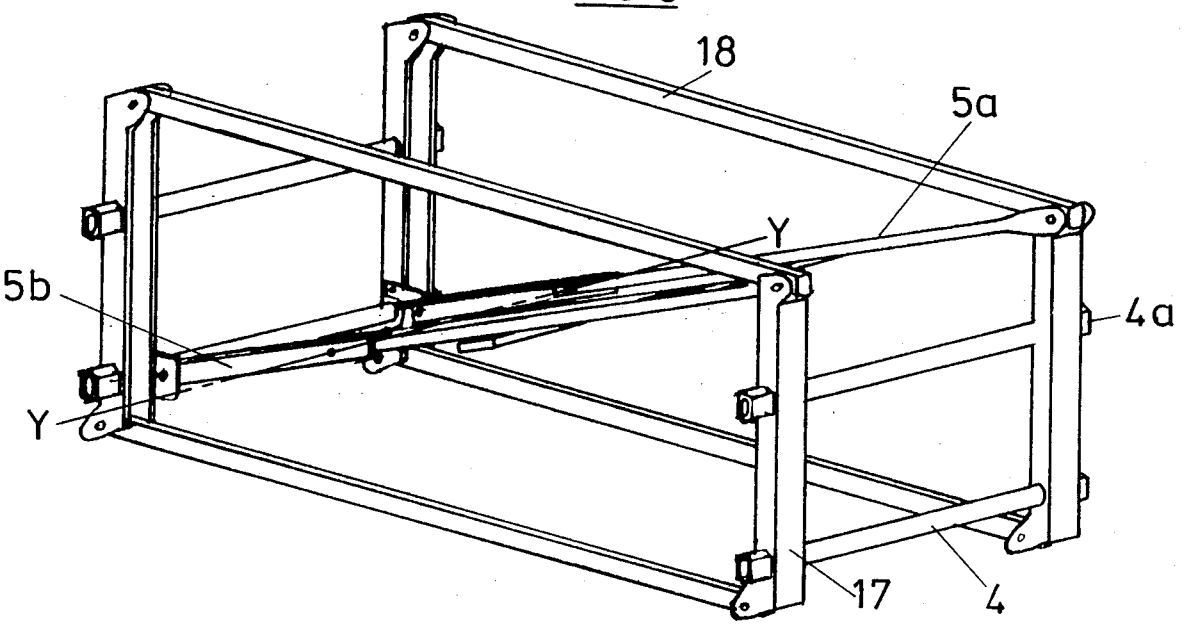
FIG. 3 is a perspective view of one erect stage.
Figure 4:
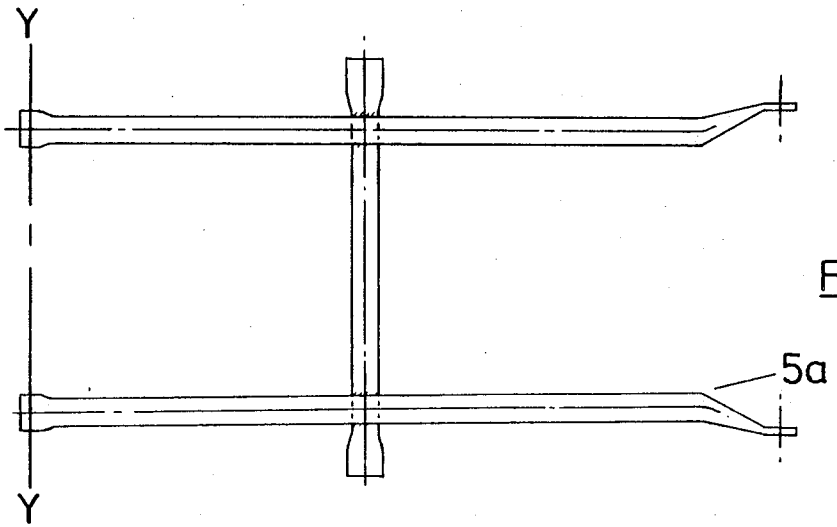
FIGS. 4 and **4*a*** are plan and side elevation views respectively of a jointed diagonal brace which forms part of each stage.
Figure 4A:
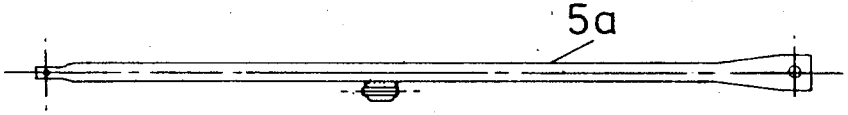

Referring to FIG. 3, it will be noted that the ends of the rungs 4 project beyond stiles 17. These rung extensions 4*a* are used in raising and lowering the stages. It will also be seen that the two jointed diagonal braces 5 in a stage comprise a H-shaped tubular assembly 5*a* (shown separately in FIGS. 4 and 4*a*) two legs of which are pivotally connected at axis Y to the two ends of the two angle or channel section components 5*b* to define the joints of the diagonal braces 5.

Figure 5A:
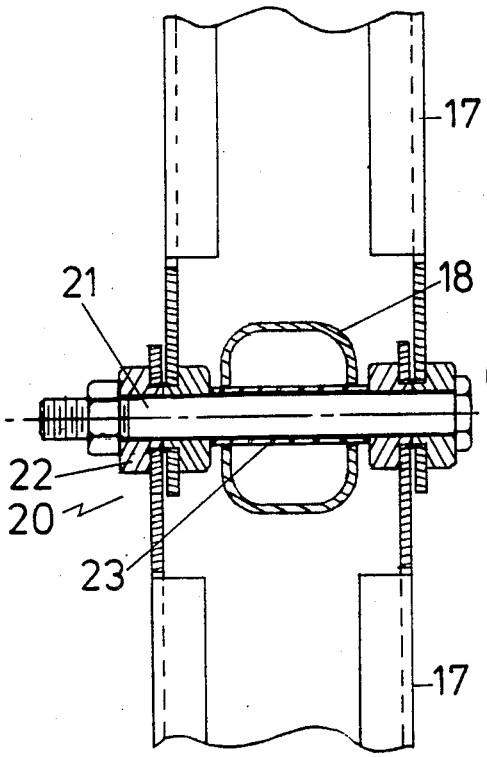
FIGS. 5 and **5*a* are, respectively, a side elevation, and a sectional end elevation on A—A of FIG. 5**, of a joint between two stages.
Figure 5:
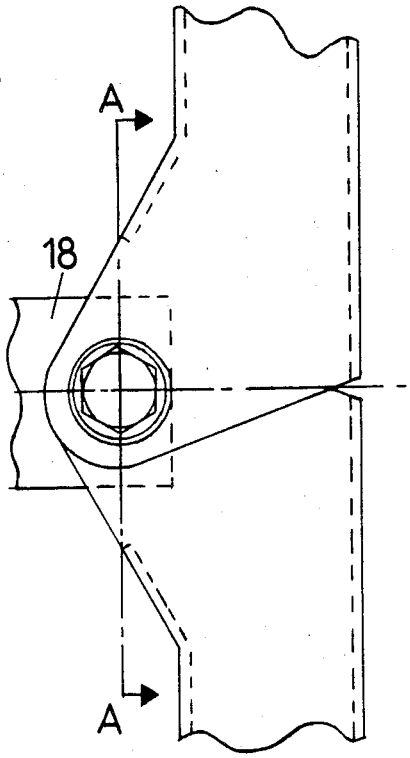

Referring now to FIGS. 5 and 5*a*, there is shown a typical joint 20 between stages 2. The principal features of the joint 20 are the pivot bolt 21, the bushing 22 which distributes the pressure of the vertical stiles 17 along the pivot bolt 21, and the tubular spacer 23 on which the horizontal brace 18 pivots.

Figure 6:
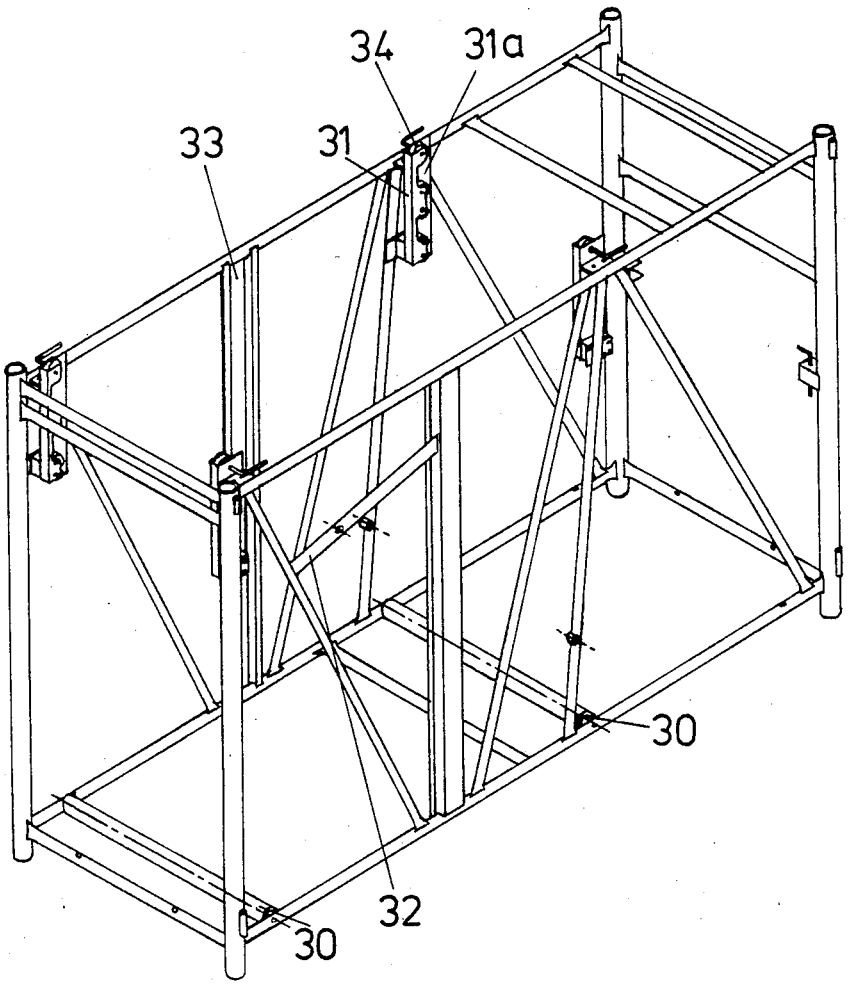
FIG. 6 is a perspective view of a chassis which constitutes the support frame.

FIG. 6 is a perspective view of the chassis 1, viewed from the opposite end to the view shown in FIG. 1. The chassis 1 comprises an open frame structure. The scaffold stages 2 (not shown in FIG. 6) sit on two fixed transverse horizontal rollers 30. Four fixed guides 31 and two inwardly facing vertical channels 33 are provided on the chassis 1 to constrain the elvation mechanism 11 to upward and downward movement. The chassis 1 houses all the collapsed stages 2 and also the lowermost erect stage. When the stages 2 are secured against collapse the rung extensions 4*a* of the lowermost erect stage lie in the upper recesses 31*a* in the fixed guides 31. Cam action locking devices 34 are provided on the chassis 1 adjacent each fixed guide 31, for securing the rung extensions 4*a* against movement when in the upper recesses 31*a*. A support member 32 is provided to which the selector lever 43 (not shown in FIG. 6) is pivotally mounted.

Figure 7:
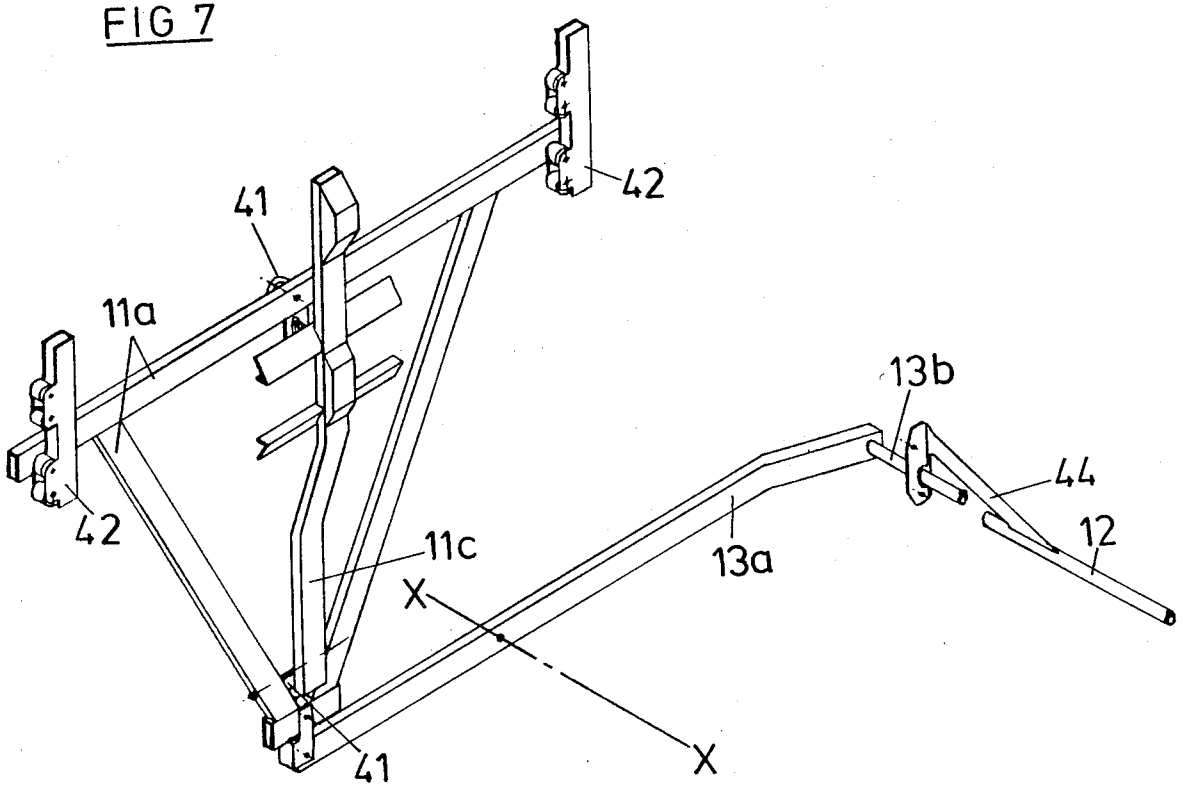
FIG. 7 is a perspective view of part of the elevation mechanism.

FIG. 7 illustrates one side of the elevation mechanism 11. The mechanism 11 comprises two triangular frames 11*a*, one at each side of and within the chassis 1. The side ilustrated in FIG. 7 is the near side as seen in FIG. 1, viewed from within the chassis 1 looking outwards. Two rollers 41 are provided on each frame 11*a*, and are constrained to roll in inwardly facing vertical channels 33 on the chassis 1. Two movable guides 42 are provided on each triangular frame 11*a*, one at each of the upper corners. The elevation mechanism 11 also includes, only on the side illustrated, for straightening the jointed diagonal brace 5, a vertical member 11*c* set inwardly with respect to the triangular frame 11*a*. FIG. 7 also shows one arm 13*a* of the pedal lever 13, the crosspiece 13*b* (partially shown) of the pedal lever 13, and the foot pedal 12 mounted to the crosspiece 13*b* by means of a bracket 44.

Figure 8:
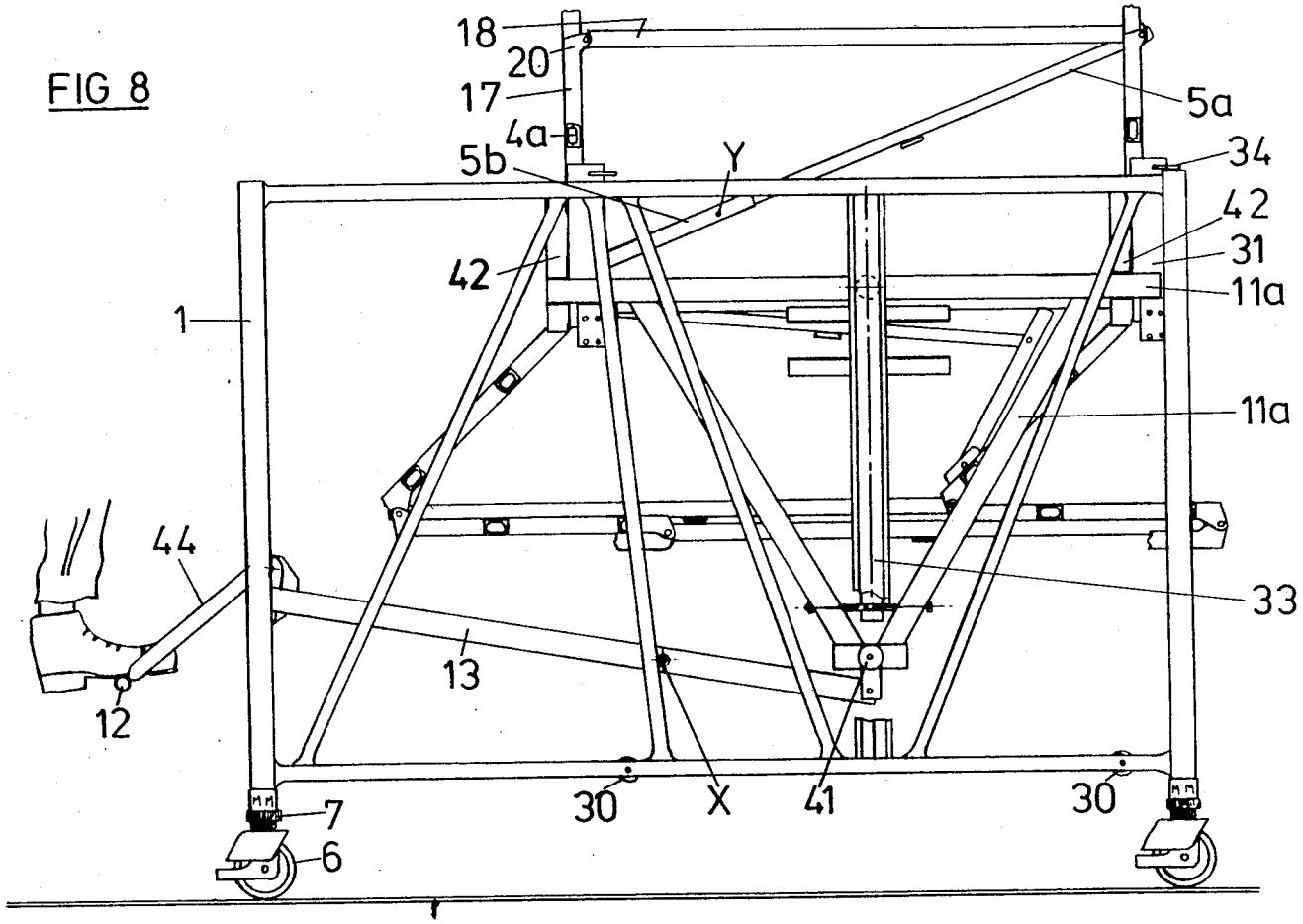
FIG. 8 is a side view of the lower part of the scaffold unit showing, inter alia, the elevation mechanism.

FIG. 8 shows the lower part of the scaffold unit, and illustrates one fully erect stage, one half erect stage, and one collapsed stage. The other stages 2 and a number of components have been omitted for clarity. Part of the channel 33 has been shown cut away to illustrate the lower roller 41.

Figure 9A:
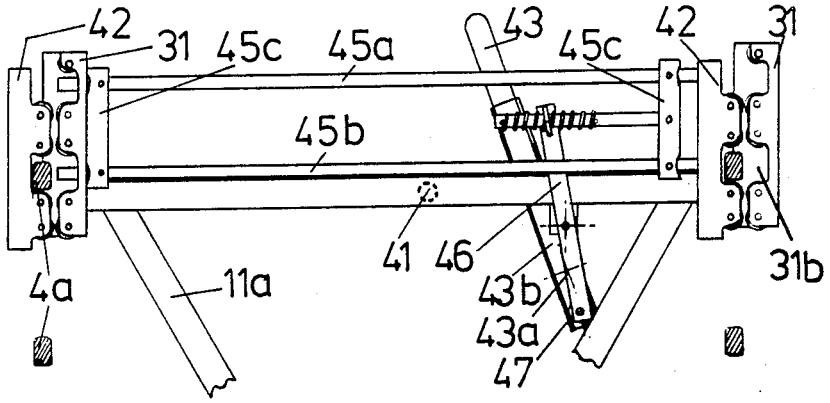
FIGS. 9*a* and 9*b* are side elevations, from inside the chassis looking outwards, of part of the chassis, scaffold and elevation mechanism illustrating the operation of the elevation mechanism at successive times during the raising of the lowermost erect stage.
Figure 9B:
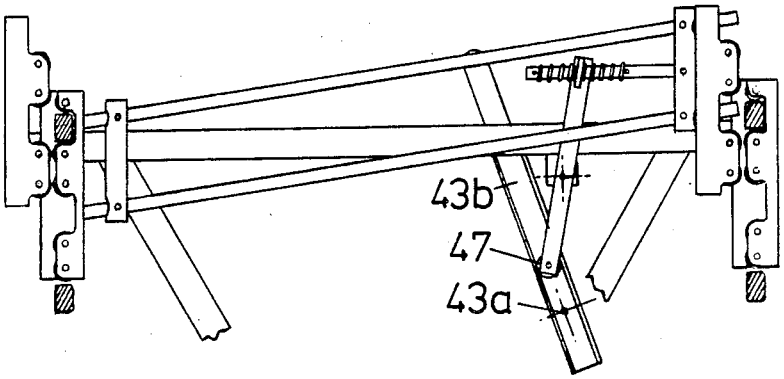

Referring now to FIGS. 9*a* and 9*b*, the additional parts of the elevation mechanism 11 will be identified and the raising of the lowermost erect stage 2 will be described. The Figures show four rung extensions 4*a*, two fixed guides 31 mounted to the chassis 1 (not shown in FIGS. 9 and 9*a*), part of one triangular frame 11*a* of the elevation mechanism 11, two movable guides 42 mounted on the triangular frame 11*a*, roller 41 (shown dotted) on the triangular frame 11*a* for running in vertical channel 33 (not shown in FIGS. 9 and 9*a*) on the chassis 1, mode selector lever 43 pivotally connected to the chassis 1 at pivot axis 43*a*, parallelogram 45 for moving the rung extensions 4*a* onto the fixed or movable guides 31, 42 and comprising upper bar 45*a*, lower bar 45*b* and vertical end pieces 45*c*, and a linkage 46 one end of which is connected to the right hand end piece 45*b* and the other end of which is provided with a roller 47 which rolls in a channel 43*b* in the mode selector lever 43. To raise the scaffolding, the selector lever 43 is moved to the appropriate position, that is swung to the left as seen in FIGS. 9*a* and 9*b*. As a result, the parellelogram 45 moves to the left (see FIG. 9*a*). The lower bar 45*b* pushes the upper left hand rung extension 4*a* into the recess in the left hand movable guide 42 thereby causing the other rung extensions 4*a* to also move to the left. The pedal 12 (not shown in FIG. 9*a* and 9*b*) is then depressed causing the triangular frame 11*a* and movable guides 42 to rise (see FIG. 9*b*), bringing the rung extensions 4*a* with them. As the triangular frame 11*a* rises, the roller 47 on the linkage 46 rides up the channel 43*b* on the selector lever 43 and the parollelogram 45 moves to the right. The lower bar 45*b* pushes the right hand upper rung extension 4*a* into the upper recess 31*a* on the right hand fixed guide 31 and thereby causes the other rung extensions 4*a* also to move to the right so that the upper rung extensions 4*a* are located in the upper recesses 31*a* of the fixed guides 31, where locking mechanisms are provided which will be described in more detail below. As shown in FIGS. 9*a* and 9*b*, the upper rung extensions 4 began in the lower recesses of the fixed guide 31 and ended in the upper recesses where they can be locked. Previously, however, the upper rung extenssions 4 were moved from their collapsed level up to the lower recesses. Thus raising rungs 4 from the collapsed state to the upper recesses where they can be locked requires that the procedure of depressing and raising the pedal 12 be effected twice. Raising a full stage requires the procedure to be carried out four times.

Figure 10A:
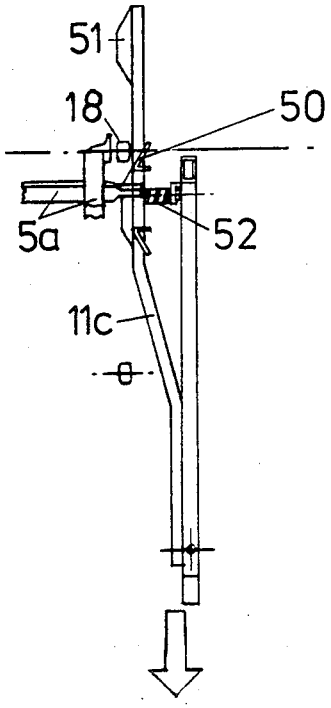
FIGS. 10*a* and 10*b* are end elevations illustrating the straightening out of the jointed diagonal brace which forms part of a stage, at successive times during the straightening of the brace.

The straightening of the diagonal braces 5 of an unfolded stage will now be described with reference to FIGS. 10*a* and 10*b*. While the lowermost erect stage is being raised first by one rung and then by another, as has just been described with reference to FIGS. 9*a* and 9*b*, the next stage unfolds from the collapsed state, first to the half erect state and then to the fully erect state. The diagonal braces 5 are still, however, knuckled. When the elevation mechanism 11 has completed the raising of the second rung, downward movement of the elevation mechanism 11 causes the upper horizontal wedge shaped catch 50 on the vertical member 11*c* to bear downwards against the diagonal brace 5 on one side of the stage, and in particular against the extension of the cross bar of the H-shaped assembly 5*a*, as may be seen in FIG. 10*a*. This action causes the jointed diagonal brace 5 to straighten out. Further downward movement of the elevation mechanism 11, however, causes the catch 50 to disengage from the diagonal brace 5.

Figure 10B:
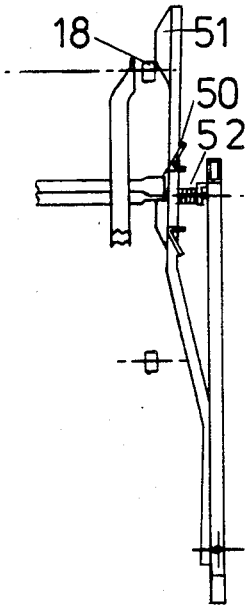

Disengagement occurs when the upper cam 51 pushes past the horizontal brace 18 of the chassis 1 and thereby moves the vertical member 11*c* against its spring loading 52, as seen in FIG. 10*b*.

Figure 11A:
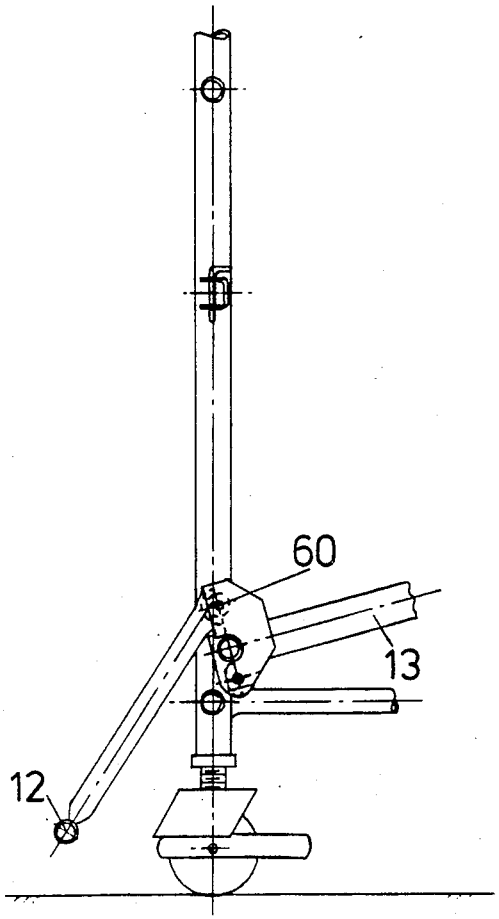
FIGS. 11*a* and 11*b* are side elevations of part of the chassis illustrating a pedal lever which forms part of the elevation mechanism, prior to and subsequent to being locked to prevent the stages from collapsing, after the required number of stages have been erected.
Figure 11B:
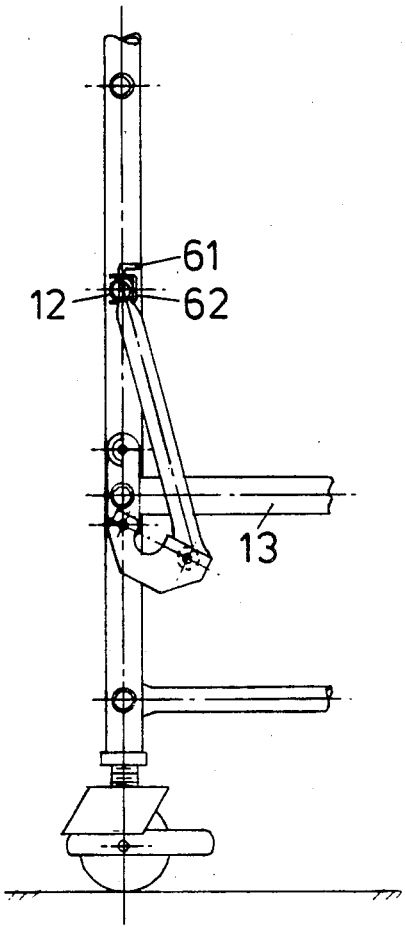

FIGS. 11*a* and 11*b* illustrate how, when all the necessary stages have been erected, the pedal lever 13 may be locked to prevent the scaffold collapsing by accidental operation of the pedal lever. FIG. 11*a* shows the pedal lever 13 in its lowermost position, immediately after erection of a stage has been completed. The lever 13 is moved to the mid-position shown in FIG. 11*b*. Captive drive pin 60 is withdrawn from the end of the lever 13 so that the movement of the pedal 12 is no longer transmitted to the lever 13. Instead the pedal 12 can pivot freely without any load. The pedal 12 is then swung to the position shown in FIG. 11*b*, where the pedal is secured by means of a locking pin 61 and brackets 62 on the chassis 1. The procedure for releasing the pedal lever 13 is the reverse of that for locking it.

Figure 12:
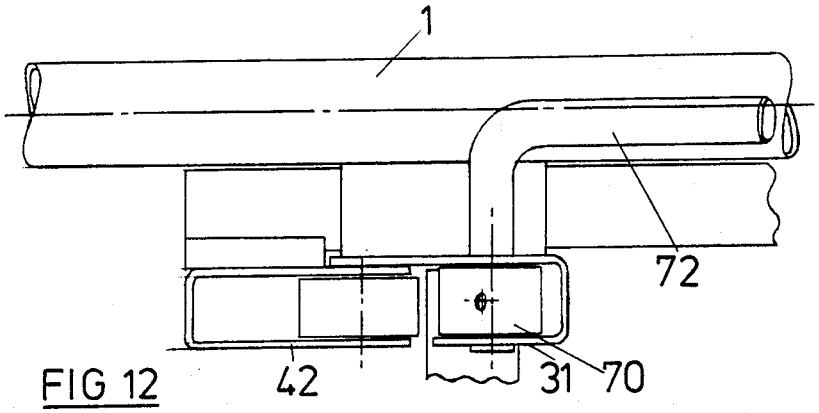
FIGS. 12 and 12*a* are plan and side elevation views respectively of a securing mechanism operable, after the required number of stages have been erected, to prevent any movement of the lowermost erect stage.
Figure 12A:
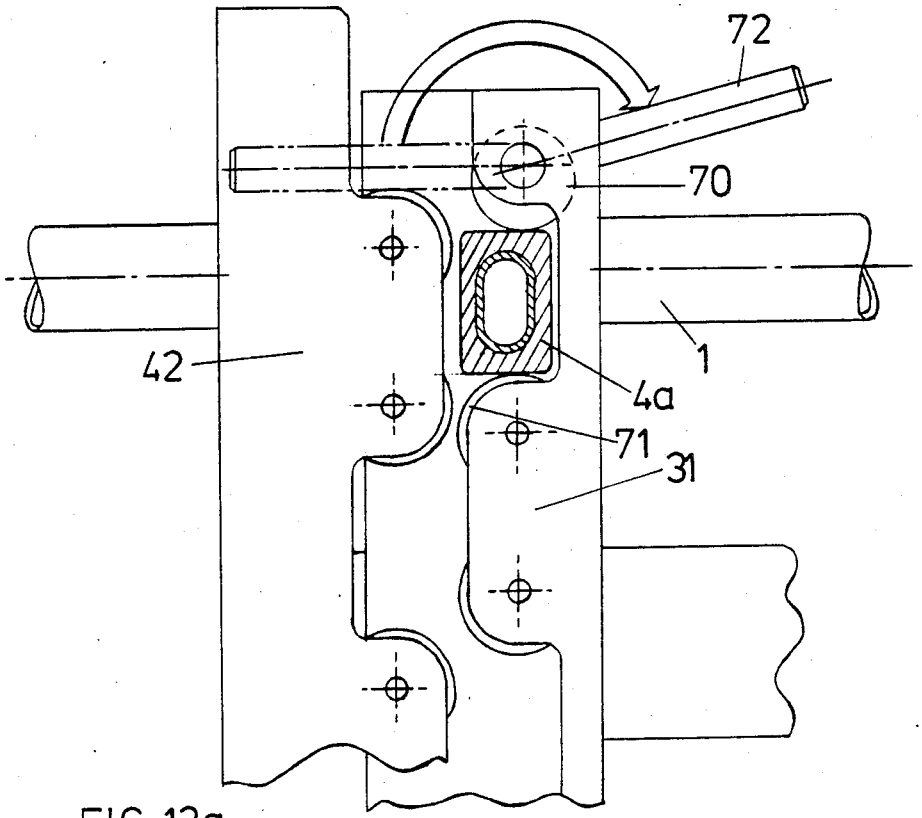

FIGS. 12 and 12*a* illustrate how, when all necessary stages have been erected, the lowermost erect stage may be secured against movement. Each of the four upper rung extensions 4*a* of the stage is secured against movement by means of a corresponding cam 70, which jams the rung extension 4*a* against the roller 71 in the fixed guide 31, and against the movable guide 42. The cam 70 is operated by means of a hand lever 72.

Figure 13A:
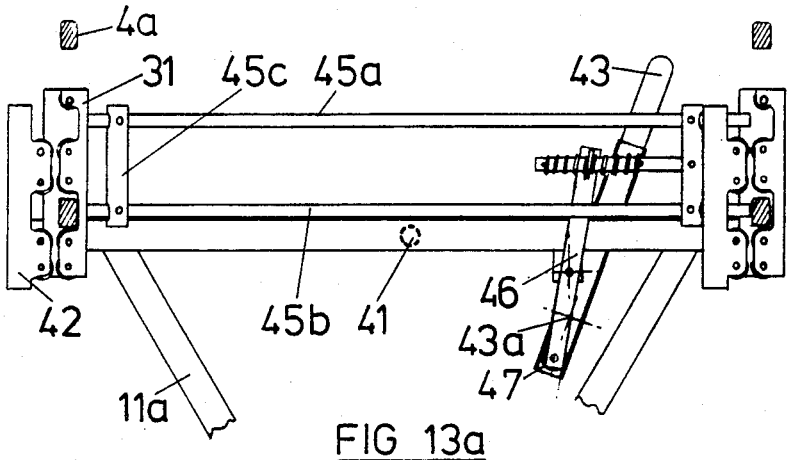
FIGS. 13*a* and 13*b* are views similar to FIGS. 9*a* and 9*b*, but showing the stage being lowered.
Figure 13B:
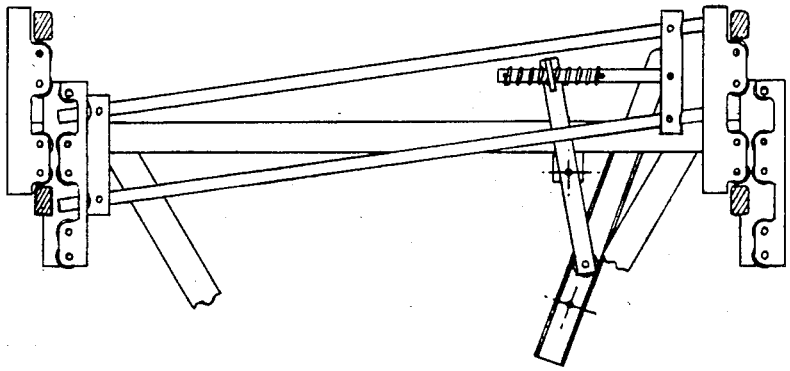

The lowering of a stage will now be described with reference to FIG. 13*a* and 13*b*. As a preliminary, the cams 70 and the pedal lever 13 are released and the selector lever 43 is moved to the appropriate position for collapse, that is swung to the right. FIG. 13*a* shows the parallelogram 45 moved to the right. The lower bar 45*b* pushes the right hand lower rung extension 4*a* into the slot in the right hand fixed guide 31 thereby causing the other rung extensions 4*a* to also move to the right (see FIG. 13*a*). The pedal 12 (not shown in FIGS. 13*a* and 13*b*) is depressed, causing the triangular frame 11*a* and movable guides 42 to rise. FIG. 13*b* shows how, as the triangular frame 11*a* rises, the roller 47 on the linkage 46 rides up the channel 43*b* on the selector lever 43 and the parollelogram 45 moves to the left. The lower bar 45*b* pushes the left hand lower rung extension 4*a* out of the lower slot 31*b* in the fixed guide 31 thereby causing the other rung extensions 4*a* to also move to the left and bringing the upper rung extensions 4*a* onto the upper shoulders on the movable guides 42. The pedal 12 is then raised causing the triangular frame 11*a* and movable guides 42 to lower, bringing the rung extensions 4*a* with them. The upper rung extensions 4*a* end up in the upper recesses 31*a* of the fixed guides 31, where they may be locked in position. As shown in FIG. 13, the upper rungs 4 began immediately above the fixed guides and finished in the upper recesses 31*a* of the fixed guides 31. Previously, however, the upper rungs 4 had been moved from the fully erect level to the half erect level shown in FIG. 13*a*, immediately above the fixed guides 31. The procedure of depressing and raising the pedal 12 is repeted twice more to lower the next rungs 4 of the stage.

Figure 14A:
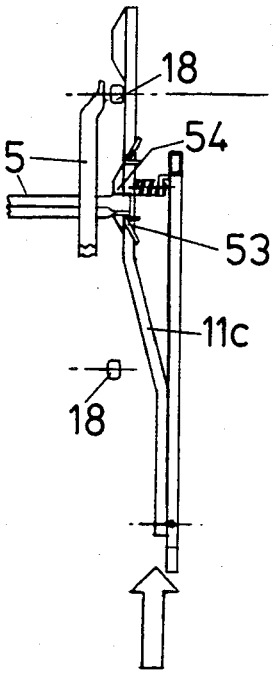
FIGS. 14*a* and 14*b* are views similar to FIGS. 10*a* and 10*b*, but showing the jointed diagonal brace being knuckled open.
Figure 14B:
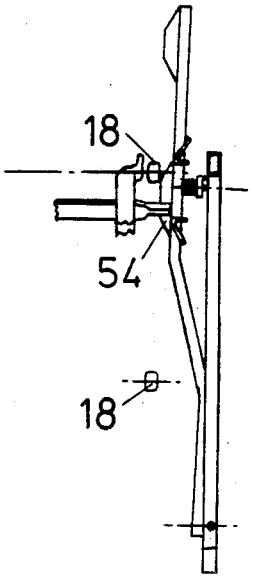

The knuckling of the diagonal brace 5 will now be described with reference to FIGS. 14*a* and 14*b*. After the stage which was engaged by the guides 31 and 42 is lowered first by one rung and then by another, the stage is located immediately below the guides 31 and 42. The stage is still, however, erect and the diagonal brace 5 is still straight. As the elevation mechanism 11 is raised to start lowering the next stage, the lower catch 53 on the vertical member 11*c* bears upwards against the diagonal brace 5, as shown in FIG. 14*a*, causing the diagonal brace 5 to knuckle. Further upward movement of the elevation mechanism 11, however, causes the lower cam 54 to push past the horizontal brace 18 on the chassis 1, disengaging the lower catch 53 from the diagonal brace 5, as may be seen in FIG. 14*b*.

Figure 15:
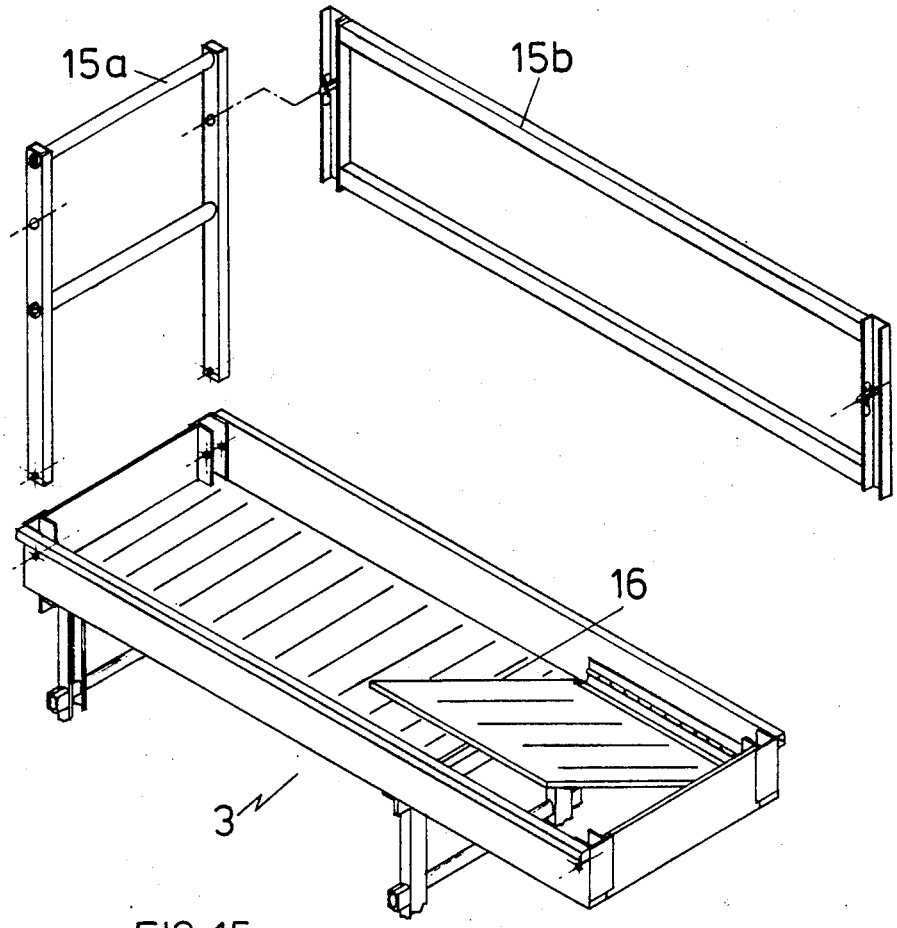
FIG. 15 is an exploded perspective view of the platform.

FIG. 15 shows the platform 3. The end guard rails 15*a* are pivotally mounted to the platform 3 so as to fold down into it during movement. The side guard rails 15*b* lie loosely on the platform during movement, beneath the folded down end guard rails 15*a*.

Figure 16:
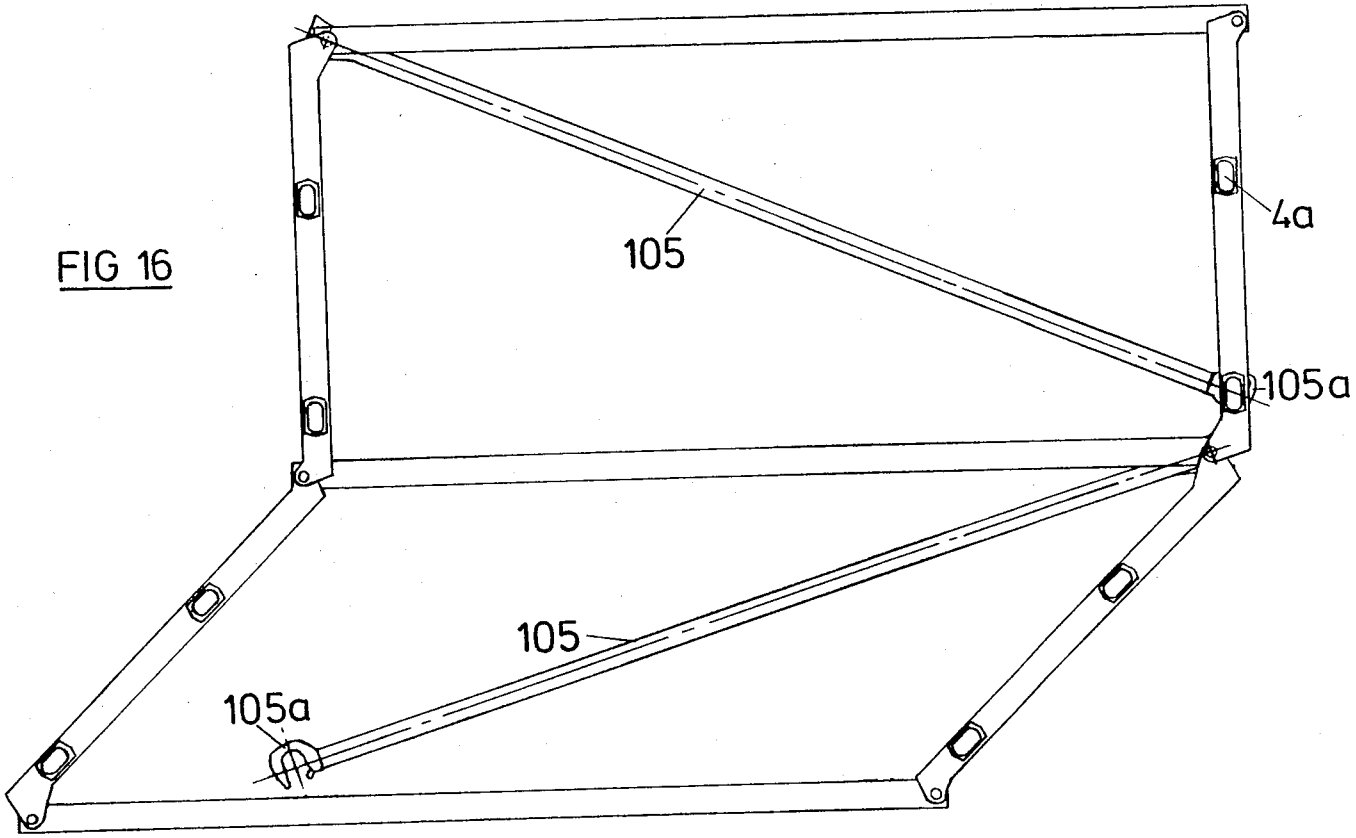
FIG. 16 illustrates an alternative construction of stage and is a side elevation of two such stages, one erect and one partially erect.

FIG. 16 shows a modified construction of stage in which the bracing mechanism comprises a rigid diagonal brace 105 at each side of the stage. One end of the rigid diagonal brace 105 is permanently pivotally connected to the stage. The other end is free and is provided with a hook 105*a* for engaging rung 4.

In a modification of the invention, the elevation mechanism may be hydraulically, pneumatically or otherwise powered.

The invention has thus far been described with reference to the erection of stages which are provided on the base, connected one above the other in a vertically extending series. It should however be appreciated that the apparatus according to the invention may be used to elevate erect scaffold stages and that additional scaffold stages may then be erected, introduced beneath the elevated scaffolding and connected thereto. In this way a scaffold tower may be built up from stages which are not stored on the base.

I claim:

1. Apparatus for elevating and lowering scaffolding comprising (a) a base; (b) associated with the base, a plurality of movable scaffold guides, such that repeating elements of an erect scaffold stage disposed above the base may be moved horizontally in one direction so as to be supported by the movable guides; (c) vertical movement means for causing simultaneous movement, between a lower and upper position, of the movable guides and scaffold elements supported thereby; (d) associated with the base, a plurality of fixed guides, such that elements of an erect scaffold stage above the base may be moved horizontally in the opposite direction so as to be supported by the fixed guides; and (e) means for preventing horizontal movement of erect scaffold stages in either direction when the movable guides are between the lower and upper positions; whereby scaffolding may be elevated or lowered by operating the vertical movement means to move the movable guides to their lower or upper positions respectively, moving the scaffolding horizontally so that elements of an erect stage of the scaffolding are supported by the movable guides, then operating the vertical movement means to move the movable guides to their opposite position, and finally moving the scaffolding horizontally so that repeating elements of an erect stage of the scaffolding are supported by the fixed guides.

2. Apparatus according to claim 1, wherein the fixed and movable guides can each support scaffold elements at different levels so that the scaffold tower may be elevated by less than the vertical separation of repeating elements of the scaffolding.

3. Apparatus according to claim 1, wherein the vertical movement means comprises a lever pivotally mounted to the base which serves as a fulcrum, and connected to the movable guides which constitute the load.

4. Apparatus according to claim 3, wherein the lever is associated with a roller which is constrained to move in a vertical channel provided on the base, and the lever bears a frame on which are mounted the movable guides.

5. Apparatus according to claim 1, wherein horizontal movement means are provided, associated with the base, which are operable to move erect scaffolding horizontally between a position in which repeating elements of an erect scaffold stage ar supported by the movable guides and a position in which elements of an erect scaffold stage are supported by the fixed guides.

6. Apparatus according to claim 5, wherein the horizontal movement means comprises a linkage connected to the vertical movement means such that the linkage may be set to operate in an elevation mode in which the linkage causes scaffolding to move horizontally from a position in which elements of an erect scaffold stage are supported by the movable guides to a position in which elements of an erect scaffold stage are supported by the fixed guides when the movable guides reach their upper position and such that the linkage may be set to operate in a lowering mode which is the reverse of the elevation mode.

7. Apparatus according to claim 1, wherein the movable and fixed guides are provided with rollers to facilitate horizontal movement of scaffolding elements.

8. Apparatus according to claim 1, wherein the base is provided with rollers to facilitate horizontal movement of collapsed stages of scaffolding connected to and beneath the erect scaffolding.

9. Apparatus according to claim 1, wherein there is provided, for use with scaffolding comprising a plurality of stages connected one above the other in a vertically extending series and each scaffolding stage being movable between a collapsed state and an erect state and including a jointed diagonal brace which may be straightened to hold the stage erect and which may be knuckled to allow the stage to collapse, diagonal brace straightening and knuckling means associated with the vertical movement means and operative when the vertical movement means is moving down relative to the scaffolding during elevation of scaffolding to engage the diagonal brace from above and to straighten it, and operative when the vertical movement means is moving up relative to the scaffolding during lowering of scaffolding to engage the diagonal brace from below and to knuckle it open.

* * * * *